US006119973A

United States Patent [19]

Galloway

[11] Patent Number: 6,119,973

[45] Date of Patent: Sep. 19, 2000

[54] RECIPROCATING APPARATUS AND CAM FOLLOWER FOR WINDING A PACKAGE

[75] Inventor: Eugene V. Galloway, Anderson, S.C.

[73] Assignee: Owens Corning Fiberglas Technology, Inc., Summit, Ill.

[21] Appl. No.: 09/240,234

[22] Filed: Jan. 29, 1999

[51] Int. Cl.[7] ..... B65H 54/28

[52] U.S. Cl. ..... 242/483.7; 242/920

[58] Field of Search ..... 242/483.7, 483.5, 242/477.1, 920, FOR 195

[56] References Cited

U.S. PATENT DOCUMENTS

| | | | |
|---|---|---|---|
| 1,083,005 | 12/1913 | Desautels et al. . | |
| 3,086,722 | 4/1963 | Altice et al. | 242/483.7 |
| 3,612,428 | 10/1971 | Hohle-Halske | 242/483.5 |
| 3,664,596 | 5/1972 | Lenk | 242/483.5 |
| 3,814,339 | 6/1974 | Hudson . | |
| 3,819,122 | 6/1974 | Genson . | |
| 3,966,133 | 6/1976 | Gelin . | |
| 3,998,404 | 12/1976 | Reese . | |
| 4,007,885 | 2/1977 | Hare et al. . | |
| 4,049,209 | 9/1977 | Bach et al. . | |
| 4,050,639 | 9/1977 | Jackson . | |
| 4,061,285 | 12/1977 | Powers . | |
| 4,085,901 | 4/1978 | Sanders . | |
| 4,116,396 | 9/1978 | Fluck | 242/483.7 |
| 4,167,252 | 9/1979 | Klink et al. . | |
| 4,192,128 | 3/1980 | Vetterli . | |
| 4,208,016 | 6/1980 | Jones et al. . | |
| 4,300,728 | 11/1981 | Andre et al. . | |
| 4,349,365 | 9/1982 | Matteson . | |
| 4,474,337 | 10/1984 | Schiminski et al. . | |
| 4,480,805 | 11/1984 | Sachleben et al. | 242/483.7 X |
| 4,657,195 | 4/1987 | Mori | 242/482.8 |
| 4,674,694 | 6/1987 | Hasegawa et al. . | |
| 4,792,104 | 12/1988 | Tate . | |
| 4,986,483 | 1/1991 | Ryu et al. . | |
| 5,690,150 | 11/1997 | Huey et al. . | |
| 5,731,084 | 3/1998 | Smith . | |
| 5,756,149 | 5/1998 | Smith . | |
| 5,762,277 | 6/1998 | Uedinger et al. . | |
| 5,806,775 | 9/1998 | Smith et al. . | |
| 5,839,678 | 11/1998 | Huey et al. . | |
| 5,850,983 | 12/1998 | Poppinghaus | 242/483.7 |
| 5,853,133 | 12/1998 | Smith . | |

*Primary Examiner*—Donald P. Walsh
*Assistant Examiner*—Collin A. Webb
*Attorney, Agent, or Firm*—Inger H. Eckert

[57] ABSTRACT

A cam follower includes a radially inner arcuate bearing surface that matches the curvature of the outer surface of the cam. Engagement of this bearing surface with the surface of the cam opposes undesired motion of the cam follower, including motion radially away from the cam, about an axis perpendicular to the cam rotation axis, and/or about an axis parallel to the cam rotation axis. This arcuate engagement also facilitates effective lubrication of the cam follower. The cam housing is formed with arcuate bearing surfaces that define with the cam surface an annular cam follower cavity and that engage a radially outer arcuate bearing surface of the cam follower, maintaining the cam follower in position against the cam surface.

20 Claims, 8 Drawing Sheets

RECIPROCATING APPARATUS AND CAM FOLLOWER FOR WINDING A PACKAGE

CROSS-REFERENCE TO RELATED APPLICATIONS

The present invention is related to the inventions of the following U.S. patent application Ser. No. 09/240,236, entitled "STRAND GUIDE EYE AND METHOD OF WINDING A PACKAGE USING THE SAME," filed Jan. 29, 1999; Ser. No. 08/683,014, entitled "METHOD AND APPARATUS FOR LUBRICATING CONTINUOUS FIBER STRAND WINDING APPARATUS," filed Jul. 16, 1996, now U.S. Pat. No. 5,756,149; and Ser. No. 08/683,083, entitled "APPARATUS FOR PRODUCING SQUARE EDGED FORMING PACKAGES FROM A CONTINUOUS FIBER FORMING PROCESS," filed Jul. 16, 1996, now U.S. Pat. No. 5,853,133.

TECHNICAL FIELD AND INDUSTRIAL APPLICABILITY OF THE INVENTION

This invention relates to the production of glass fibers, and in particular, to winding a glass fiber strand to form packages. More particularly, this invention relates to a reciprocating apparatus for reciprocating a glass fiber strand along the length of a glass fiber package, and to a cam follower used with a barrel cam in the reciprocating apparatus. The invention can be useful in the production of fiber strand products for use as a reinforcement in molded resinous articles.

BACKGROUND OF THE INVENTION

Mineral fibers are used in a variety of products. The fibers can be used as reinforcements in products such as plastic matrices, reinforced paper and tape, and woven products. During the fiber forming and collecting process numerous fibers are bundled together as a stand. Several strands can be gathered together to form a roving used to reinforce a plastic matrix to provide structural support to products such as molded plastic products. The strands can also be woven to form a fabric, or can be collected in a random pattern as a fabric. The individual strands are formed from a collection of glass fibers, or can be comprised of fibers of other materials such as other mineral materials or organic polymer materials. A protective coating, or size, is applied to the fibers which allows them to move past each other without breaking when the fibers are collected to form a single strand.

Typically, continuous fibers, such as glass fibers, are mechanically pulled from a feeder of molten glass. The feeder has a bottom plate, or bushing, which has anywhere from 200 to 10,000 orifices. In the forming process, the strand is wound around a rotating drum, or collet, to form, or build, a package. The completed package consists of a single long strand. It is preferable that the package be wound in a manner that enables the strand to be easily unwound, or paid out. It has been found that a winding pattern consisting of a series of helical courses laid on the collet builds a package that can easily be paid out. Such a helical pattern prevents adjacent loops or courses of strand from fusing together should the strand be still wet from the application of the size material. The helical courses are wound around the collet as the package begins to build. Successive courses are laid on the outer surface of the package, continually increasing the package diameter, until the winding is completed and the package is removed from the collet.

A strand reciprocator guides the strand longitudinally back and forth across the outer surface of the package to lay each successive course. A known strand reciprocator that produces square edged, cylindrical packages includes a cam having a helical groove, a cam follower which is disposed within the groove and a strand guide attached to the cam follower. As the cam is rotated, the cam follower and strand guide move the strand longitudinally back and forth across the outer surface of the rotating package to lay each successive course.

FIGS. 1 and 2 show a conventional winder 5 with a strand supply 40. Fibers 43 are drawn from a plurality of orifices 42 in a bushing 41 and gathered into a strand 44 by a gathering member 45. Size is applied to coat the fibers by size applicator 46. The strand 44 is wound around a rotating collet 31 in a winding apparatus 30 to build a cylindrical package 20.

The winder 5 includes a strand reciprocator 10 that guides the strand 44 laterally back and forth across the package surface 21 to lay the strand in courses 24 on the package surface. The strand reciprocator 10 also includes a cylindrical cam 11 that has a helical groove 12 with curved ends 13 and is mounted for rotation about its axis 14. A cam follower 15 is disposed in the groove 12. The cam follower 15 extends outwardly from the cam and a strand guide 17 is attached to the end. A notch 18 is formed in the strand guide 17 to hold the strand 44. The cam follower 10 is restrained from rotating with the cam, so that rotation of the cam causes the cam follower to follow the helical groove, moving laterally across the package surface.

As shown schematically in FIGS. 3A and 3B, cam follower 15 includes a cam groove engaging portion, or "boat," 16 fitted into the cam groove 12. Upper and lower guides 51, 52 abut the upper and lower sides of the cam follower 15 to restrain it in the tangential directions as the cam 11 rotates in direction R. As the cam rotates, the side wall of cam groove 12 applies to the cam groove engaging portion 16 a normal force $F_N$ at its point of contact with the cam groove. Normal force $F_N$ has a longitudinal component $F_L$ and a tangential component $F_T$. Longitudinal component $F_L$ urges the cam follower longitudinally to the right in FIG. 3A, providing the desired function of converting rotation of cam 12 into translation of cam follower 15.

The cam follower and the structures that it engages need to perform several other functions for the strand reciprocator to function properly. First, the tangential component $F_T$ of the normal force $F_N$ must be opposed to prevent the cam follower from moving downwardly. Second, cam follower 15 must be restrained radially to prevent it from moving radially out of cam groove 12. Third, the desired orientation of follower 15 with respect to the tangential direction R (for example, to maintain the notch 18 in the vertical orientation shown in FIG. 3A) needs to be established and maintained. Fourth, the cam follower 15 needs to be maintained in the appropriate orientation about the longitudinal axis L, to resist rotative moments about axis L (explained below). If cam groove 12 crosses itself (i.e. if more than a half-rotation of the cam is required for the cam follower to traverse the full length of the cam) the cam groove engaging portion 16 must be elongate, to be able to span the crossing (such as crossings C in FIG. 2). For high traverse speeds, desirable in strand winding, the cam follower should have a low mass to reduce the forces required to decelerate the cam follower to zero speed and to accelerate the follower to full speed at the ends of the traverse. Finally, for high speed operation, proper lubrication must be supplied to the cam follower's contact surfaces to reduce friction and wear.

FIGS. 3A and 3B schematically illustrate several of these functions. The tangential component $F_T$ of the normal force $F_N$ is opposed by force $F_{T2}$ applied by lower guide 52 to the lower face of cam follower 15. Since the opposed forces $F_T$ and $F_{T2}$ are radially offset, they generate a moment tending to rotate cam follower 15 clockwise in FIG. 3A. This moment is opposed by forces generated by engagement of the cam follower with other structures, such as by the force $F_{M1}$ at the contact between the cam groove engaging portion 16 and the bottom of cam groove 12 and the opposed force $F_{M2}$ generated at the contact between the cam follower 15 and the side of lower rail 52. The orientation of cam follower 15 with respect to the tangential direction R is maintained by engagement of the follower 15 with upper and lower rails 51, 52. The illustrated cam groove engagement portion 16 is cylindrical, and therefore could not be used with a multi-turn cam.

A known cam follower mechanism is illustrated schematically in FIGS. 4A and 4B. Cam follower 15 has an elongate cam groove engagement portion or boat 16, which permits the cam follower to traverse cam groove crossings. Since the cam follower is of one-piece construction, and the boat 16 is fixed with respect to the body of the cam follower, the follower 15 assumes the orientation of the cam groove 12. The cam follower 15 would therefore be oriented obliquely in the opposite direction to that shown in FIG. 4A when the follower 15 is an oppositely-angled portion of cam groove 12. The tangential component of the normal force on the cam follower is opposed by engagement of lower rail 52 with the lower oblique face 15*a* of the cam follower. Radially-outward movement of the cam follower is prevented by engagement of the arcuate outer surface of boat 16 with the arcuate inner faces of the rails 51, 52.

Another known cam follower mechanism is illustrated schematically in FIGS. 5A and 5B. Cam groove 12 is stepped, with an outer groove and a narrower, inner groove. Cam follower 15 has a cylindrical outer cam groove engagement portion 19*a* to engage the outer groove and an elongate, pivotally-mounted inner cam groove engagement portion 19*b* to engage the inner groove and span crossings of the grooves. Cam follower 15 includes upper and lower channels 53, 54 that engage rails 51, 52. The engagement of the rails and channels fixes the orientation of the cam follower in the radial direction, about the longitudinal axis, and with respect to the tangential direction.

Although the known cam follower mechanisms described above work well, they suffer from some shortcomings. The first cam follower mechanism does not maintain a fixed orientation of the follower, and provides relatively small bearing surfaces, which are difficult to lubricate effectively. The second cam follower is more complex, with a separate, movable cam groove engagement portion, and has a relatively high mass. Further, the engagement of the channels and rails is difficult to lubricate.

SUMMARY OF THE INVENTION

The shortcomings of the prior art are overcome by the disclosed reciprocating apparatus and cam follower. The cam follower includes a radially inner arcuate bearing surface that matches the curvature of the outer surface of the cam. Engagement of this bearing surface with the surface of the cam opposes undesired motion of the cam follower, including motion radially away from the cam, about an axis perpendicular to the cam rotation axis, and/or about an axis parallel to the cam rotation axis. This arcuate engagement also facilitates effective lubrication of the cam follower. The cam housing is formed with arcuate bearing surfaces that define with the cam surface an annular cam follower cavity and that engage a radially outer arcuate bearing surface of the cam follower, maintaining the cam follower in position against the cam surface.

DETAILED DESCRIPTION AND PREFERRED EMBODIMENTS OF THE INVENTION

Figure 6B:
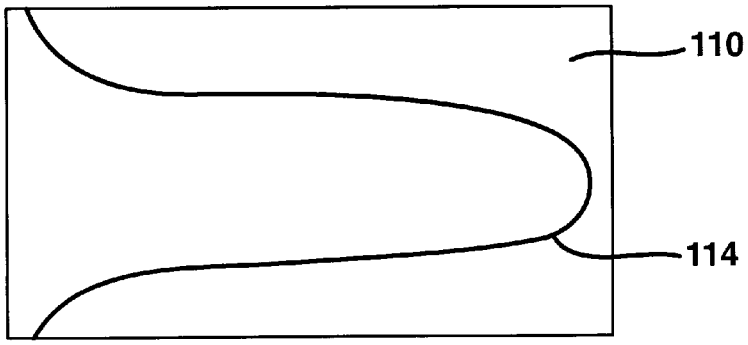
FIG. 6B is a schematic plan view of the groove in the cam shown in FIG. 6A.
Figure 3A:
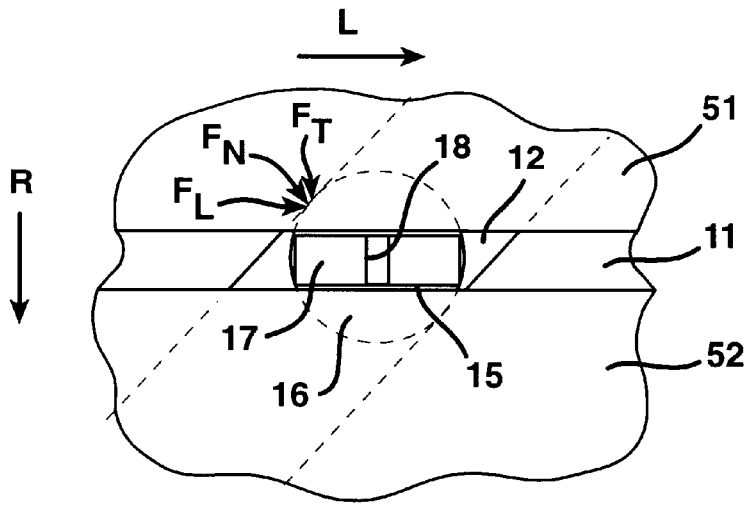
FIG. 3A PRIOR ART
FIGS. 3A and 3B are schematic front and side views of the cam follower of FIG. 2.
Figure 3B:
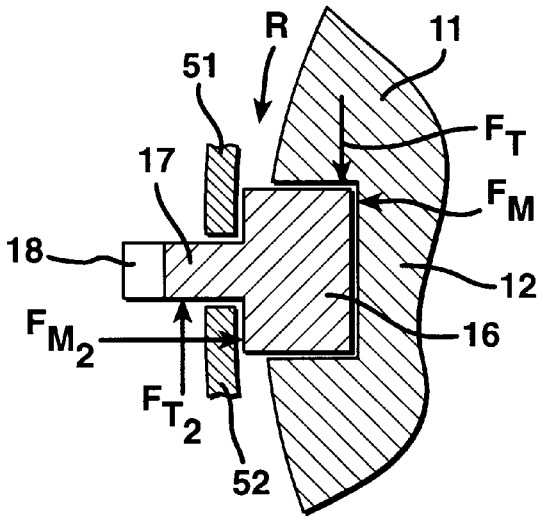
FIG. 3B PRIOR ART
Figure 4A:
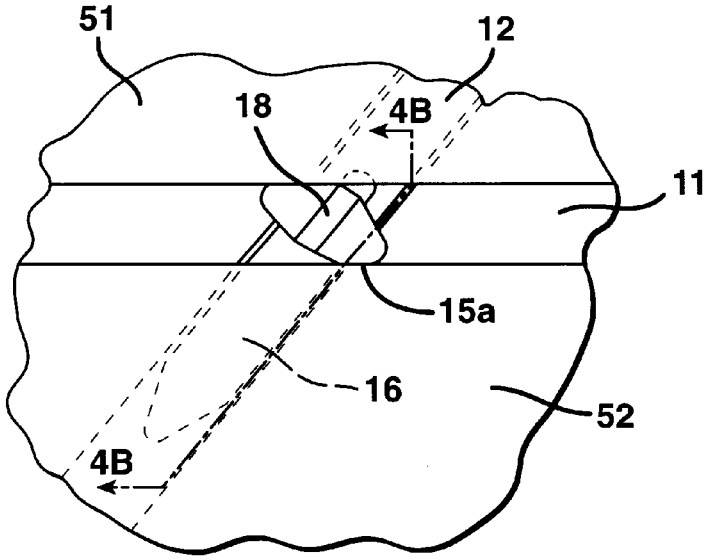
FIG. 4A PRIOR ART
FIGS. 4A and 4B are schematic front and side views of a known cam follower mechanism.
Figure 4B:
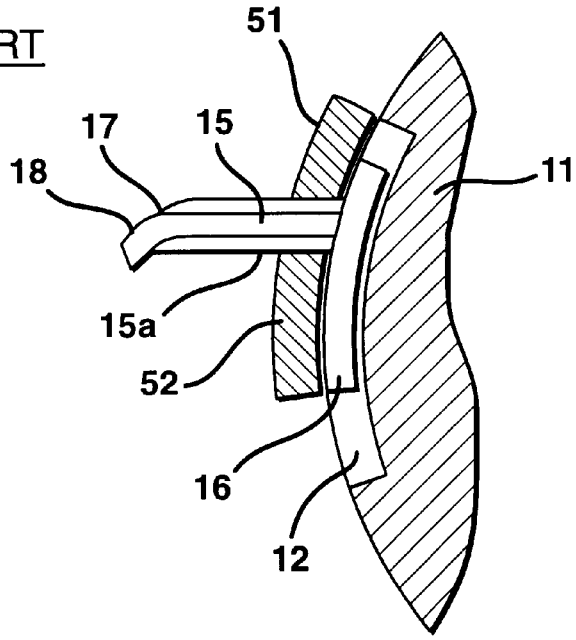
FIG. 4B PRIOR ART
Figure 5A:
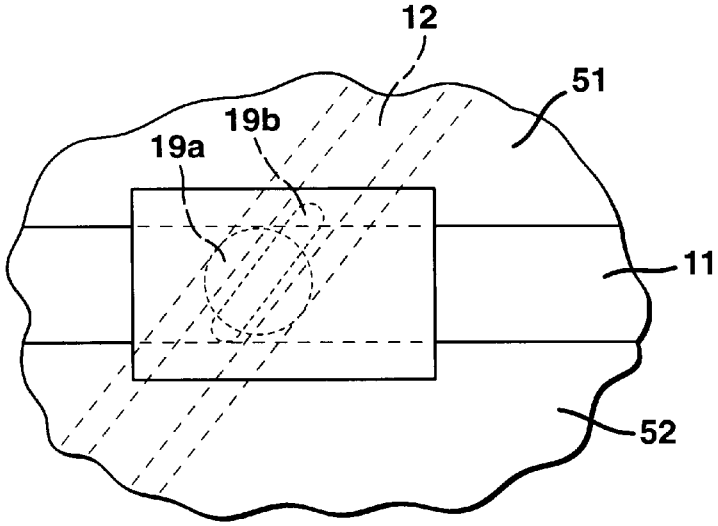
FIG. 5A PRIOR ART
FIGS. 5A and 5B are schematic front and side views of another known cam follower mechanism.
Figure 5B:
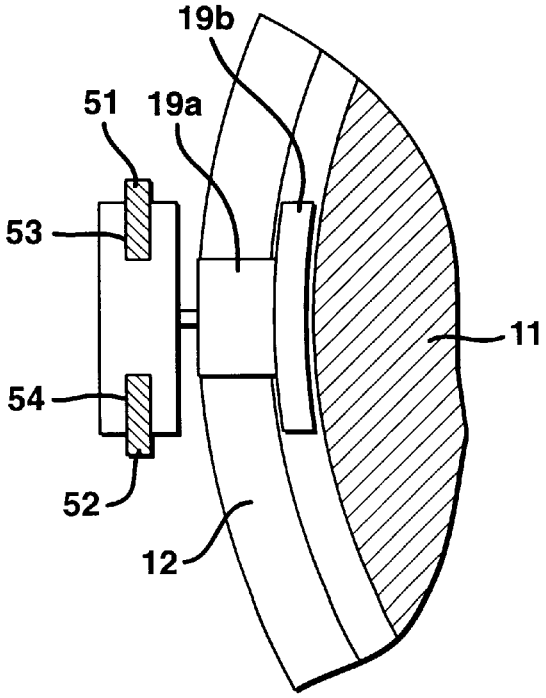
FIG. 5B PRIOR ART
Figure 6A:
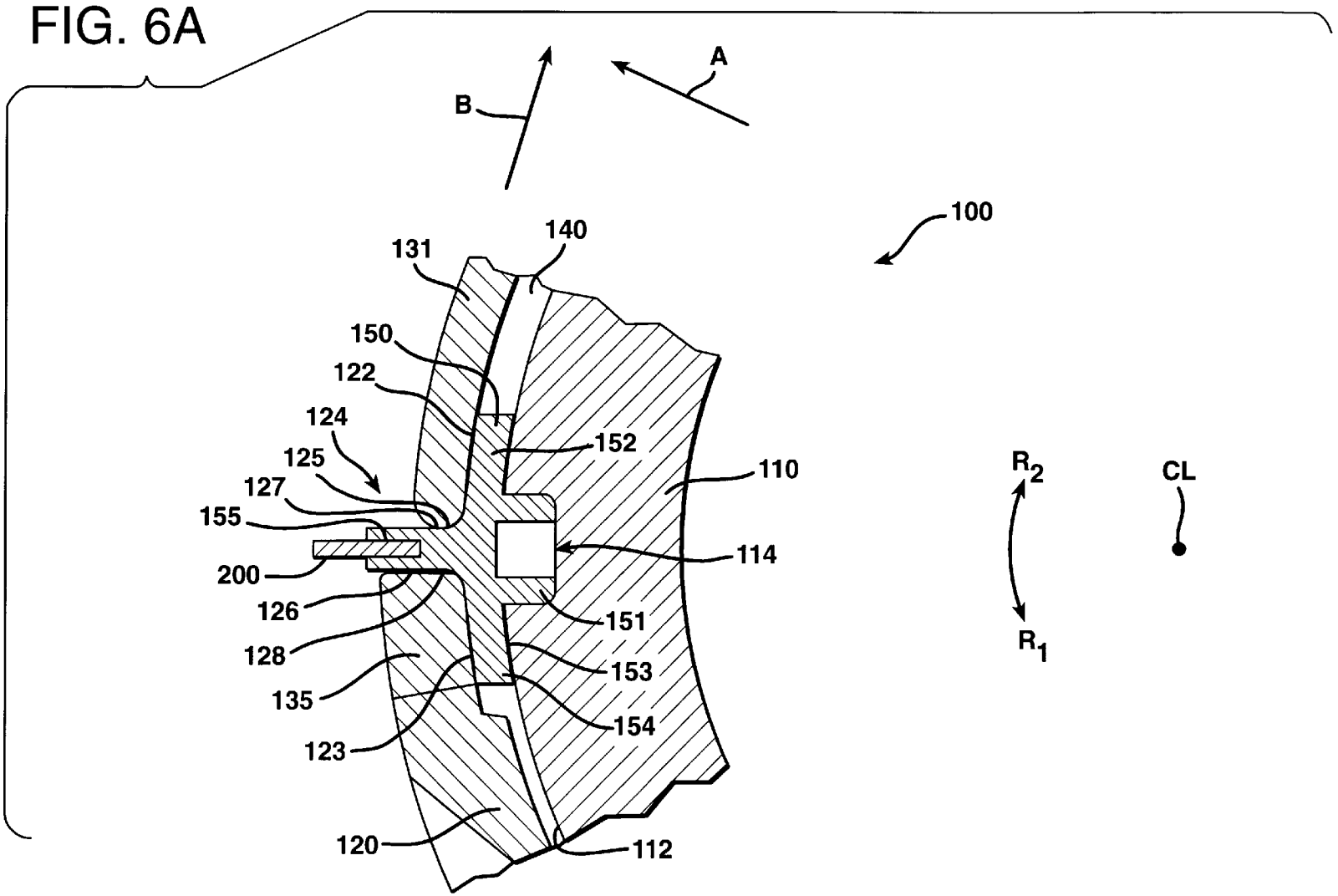
FIG. 6A is a cross-sectional view of a cam follower and barrel cam embodying the principles of the invention.
Figure 7A:
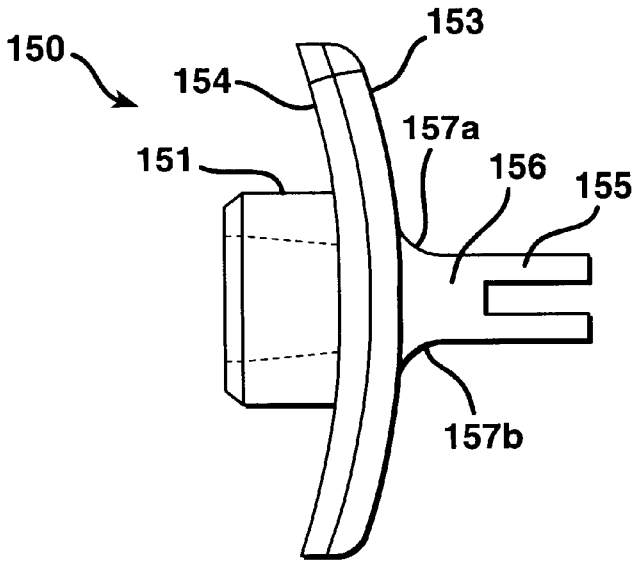
FIGS. 7A–7D are side, rear, cross-section, and isometric views of the cam follower of FIG. 6A.
Figure 7B:
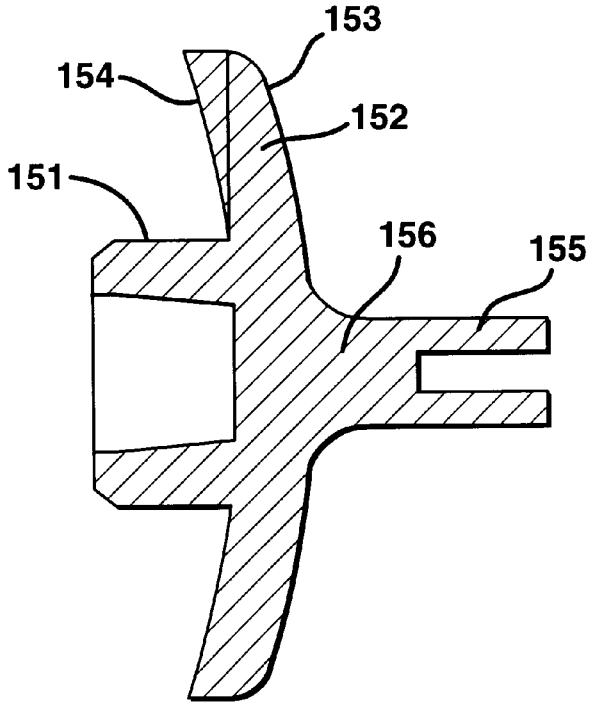
Figure 7C:
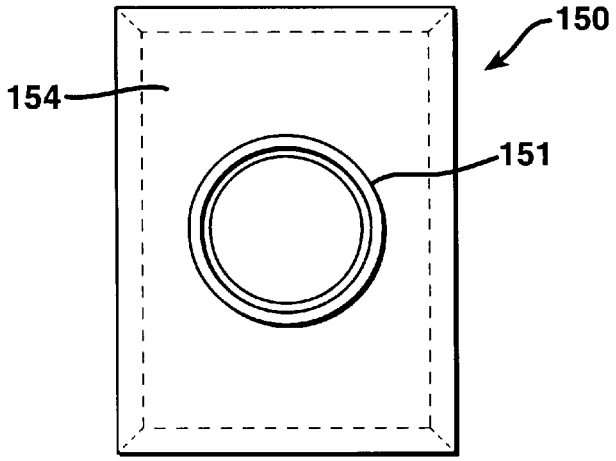
Figure 7D:
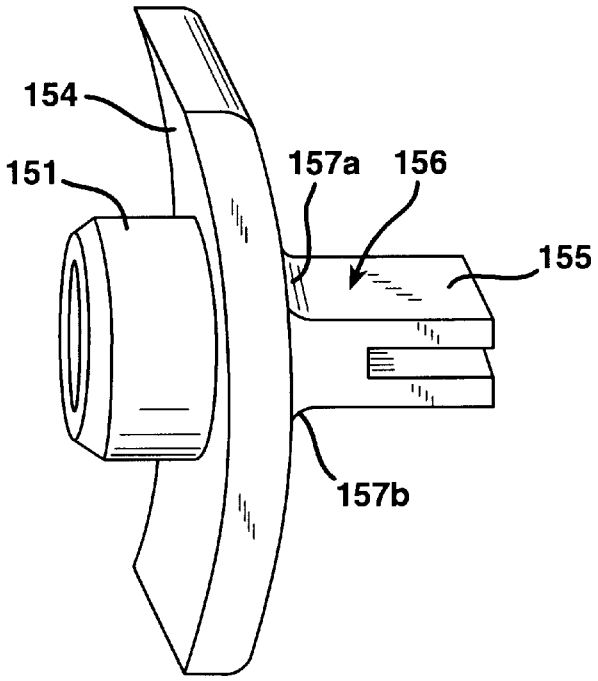

A reciprocating apparatus and cam follower incorporating the principles of the invention are illustrated in FIGS. 6–7D. The disclosed reciprocating apparatus and cam follower improve the positioning of the cam follower on a barrel cam and the lubrication of the bearing surfaces of the cam follower by providing arcuate surfaces on the cam follower to bear against the outer surface of the cam barrel and against an arcuate surface of the cam housing.

As shown in FIG. 6A, reciprocating apparatus 100 includes a barrel cam 110 for reciprocally traversing a cam follower 150 and an attached strand guide 200 to wind a package on a rotating collet (not shown) disposed adjacent the reciprocating apparatus. The longitudinal, rotational axes of the collet and the barrel cam 110 are preferably parallel. Reciprocating apparatus 100 further includes a cam housing 120 in which cam 110 is mounted.

The barrel cam 110 has an outer surface 112 with an outer radius and a helical groove 114 formed therein. As the barrel cam 110 rotates about its longitudinal axis, the helical groove 114 follows a path that reciprocates from one end of the cam to the other. In the disclosed embodiment, cam 110 is a half-turn cam, in that the groove completes a full longitudinal traverse of the cam in one-half revolution of the cam about its axis. The groove is shown schematically in FIG. 6B, in which the outer surface of cam 110 is shown as though unrolled and laid flat. Since the groove does not cross itself, there are no crossings to be negotiated by the boat of the cam follower. This cam groove geometry improves control over placement of the strand on the package, since passage of the boat through crossings inevitably produces slight perturbations in the path of the cam follower and thus of the strand. Housing 120 is disposed about, and radially spaced from cam 110, defining an annular cam follower cavity 140 between the outer surface 112 of the cam and the radially inner surface of the housing. Housing 120 includes arcuate upper and lower plates 131, 135. Plates 131, 135 include arcuate radial bearing surfaces 122, 123, respectively, and arcuate edges 125, 126, with tangential bearing surfaces 127, 128, respectively. An elongate cam follower slot 124 is defined between edges 125, 126. Radial bearing surfaces 122, 123 are radiused in the region about cam follower slot 124 with an axis of curvature coaxial with the cam longitudinal centerline CL.

Cam follower 150 includes a cam groove engaging portion or boat 151, an arcuate cam surface engaging member or flange 152, and a guide eye carrier portion 155 to carry strand guide 200.

Figure 1:
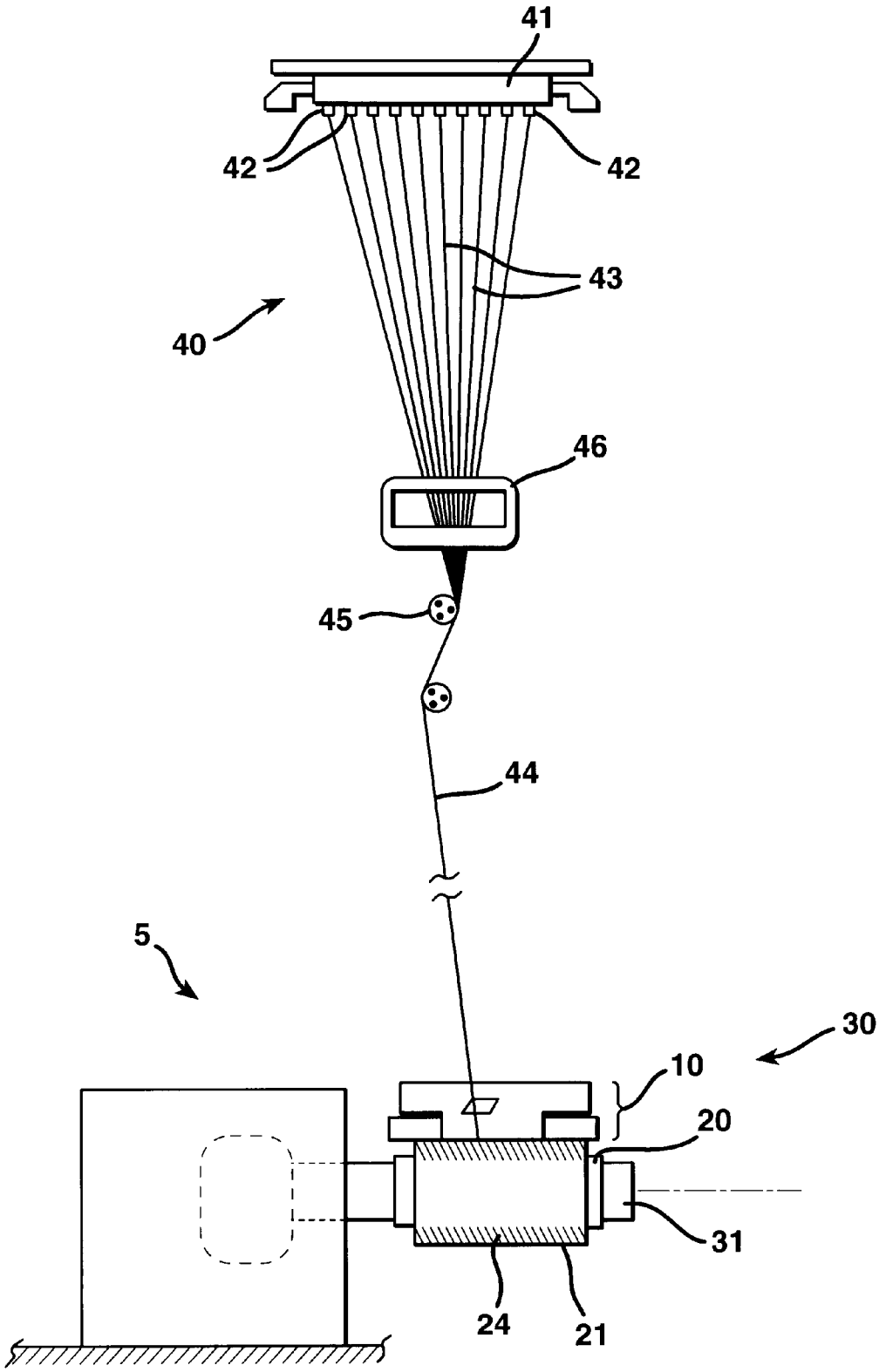
FIG. 1 PRIOR ART
FIG. 1 is a schematic view in elevation of a known apparatus for forming, collecting and winding fiber strands.
Figure 2:
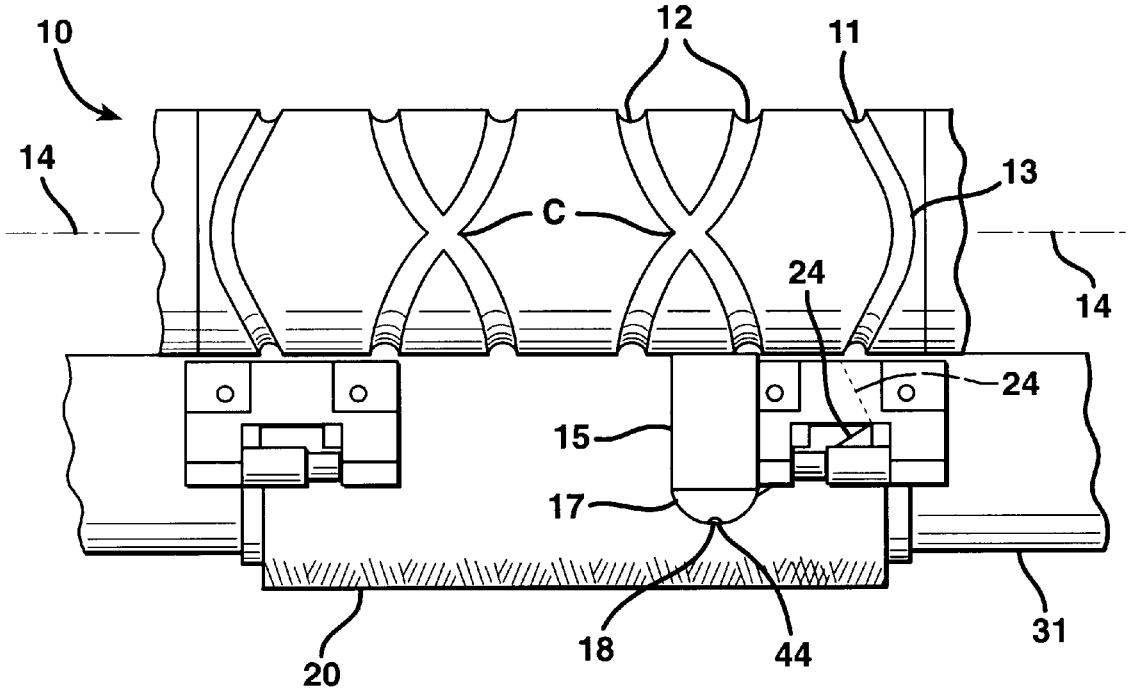
FIG. 2 PRIOR ART
FIG. 2 is an enlarged, schematic view in elevation of the strand reciprocator shown in FIG. 1.

Boat 151 is formed as a generally cylindrical, hollow skirt extending from the radially inner side of the cam follower. Cam surface engaging flange 152 is rectangular in elevation, and has arcuate radially inner and outer faces 154, 153, respectively. Guide eye carrier portion 155 is disposed at the radially outer end of radially-outwardly extending projection 156, which is rectangular in cross-section. In the illustrated embodiment, carrier portion 155 includes a transverse slot into which any suitable strand guide eye, as illustrated in FIG. 2, can be inserted, or preferably, insert molded with the cam follower.

Projection 156 includes upper and lower tangential bearing surfaces 157*a*, 157*b*, which include radiused portions that transition from outer face 153 of flange 152 to the planar surfaces of projection 156.

As shown in FIG. 6A, cam follower 150 is disposed in cam follower cavity 140 with boat 151 disposed in the groove 114, with inner face 154 of flange 152 engaging the outer surface 112 of the cam, and with projection 156 extending radially outwardly from cam follower cavity 140 through cam follower slot 124. As the cam 110 rotates, the longitudinal force (as described above) from the contact of the side of the groove 114 on boat 151 directs the cam follower 150 to reciprocally traverse along a traverse path as it moves in groove 114. The traverse path is linear and aligned in an axial direction that is parallel to the cam axis CL.

The reciprocating apparatus maintains the cam follower 150 in a fixed orientation with the respect to the radial direction and the tangential direction of the cam 110 (the direction of a line drawn tangent to the outer surface of the cam and perpendicular to the longitudinal axis). Radially inner radial bearing surface 154 bears against outer surface 112 of cam 110. The radius of curvature of bearing surface 154 is slightly larger than the radius of curvature of the cam, so that when the cam follower is disposed in an operative position on the cam, the axis of curvature of the bearing surface is coaxial with the cam axis CL. By matching the radius of curvature of the bearing surface and the cam surface, a close fit between the surfaces is achieved.

Radially outer radial bearing surface 153 bears against the cam housing radial bearing surfaces 122, 123, and has a radius of curvature that matches those of the housing bearing surfaces. Correspondingly, the thickness of flange 152 is slightly less than the radial width of cam follower cavity 140, so that flange 152 is held closely between cam 110 and bearing cam housing radial bearing surfaces 122, 123. This leads to several results.

First, engagement of bearing surface 154 with cam surface 112 and of bearing surface 154 with bearing surfaces 122, 123 resists undesired motion of the cam follower: a) in an outward radial direction, as designated by arrow "A" in FIG. 6; b) about an axis in the radial direction; and c) about an axis parallel to the axis CL of the cam. Second, close engagement of the arcuate bearing surfaces facilitates effective lubrication. During operation of the reciprocating apparatus, lubrication of the bearing surfaces on the cam follower is required to reduce wear to the follower. The bearing surfaces may be lubricated in the same manner as disclosed in commonly-assigned U.S. Pat. No. 5,756,149 to Smith, the disclosure of which is hereby expressly incorporated by reference herein. A lubricating fluid is supplied between the bearing surfaces. As the cam follower 150 slides along the surfaces of the cam housing 120 and the cam 110, the lubricating fluid develops into a layer of film to reduce the frictional forces between the bearing surfaces and lengthen the life of the cam follower. The arcuate shape of the bearing surfaces facilitates the lubrication process since the rotation of the cam tends to urge the lubricant into narrow annular space between the bearing surfaces, in similar fashion to automotive engine crank bearings.

Tangential movement of the cam follower (in, or opposite to, direction B in FIG. 6) with the cam is opposed by the engagement between tangential bearing surface 128 (on cam housing edge 126) and cam follower tangential bearing surface 157*b* when the cam is rotated in direction $R_1$. Similarly, tangential movement of the cam follower is opposed by engagement between tangential bearing surface 127 (on cam housing edge 125) and cam follower tangential bearing surface 157*a* when the cam is rotated in direction $R_2$. Since boat 152 is cylindrical, cam 110 can be rotated in either direction $R_1$ or $R_2$ in operation, and it is preferred to change rotational directions periodically to even out the wear on the cam follower.

The cam follower 150 is preferably formed by molding a polymeric composition such as a mixture of 80% nylon and 20% polytetrafluoroethylene. Other suitable materials will be apparent to the artisan.

The dimensions of the illustrated cam follower are as follows:

Width of flange 152=0.874"

Height of flange 152=1.186"

Diameter of boat 151=0.5"

Length of boat 151=0.24"

Height of carrier portion 155=approximately 0.19"

Width of carrier portion 155=0.5"

Length from end of carrier portion to end of boat=0.787"

It is to be appreciated that the reciprocating apparatus and cam follower may be implemented consistent with the principles of the invention in ways other than illustrated above. Although illustrated with a cylindrical boat for use with a half-turn cam, the cam follower could include an elongated boat for use with multi-turn cams having crossings, provided that the boat is mounted for rotation relative to the cam follower so that the cam follower can be maintained in a fixed orientation.

Although illustrated as being integrally formed, the cam follower could be assembled from multiple elements.

The radially inner surface of the housing need not be radiused to define an annular cam follower cavity, nor need it be arcuate. Thus, the radially outer bearing surface of the cam follower flange could be planar and the inner bearing surface of the cam housing provide planar surface contact or line contact with the flange. Since there is no relative rotational movement between the cam follower and the housing, there is no lubrication benefit to arcuate bearing surfaces.

The height and width of the flange may be varied, but should be sufficiently large to maintain contact with the cam surface on both sides of the cam groove at the arcuate ends of the cam groove.

I claim:

1. A cam follower for use with a cylindrical cam barrel having a predetermined outer radius, an outer surface, and a cam groove disposed oblique to an axis of rotation of the cam barrel and adapted to urge the cam follower along a path parallel to the axis of rotation of the cam, and a cam housing having an arcuate, radial bearing surface with a radius of curvature, comprising:

a cam groove engaging member adapted to engage the cam groove; and a cam surface engaging member coupled to said cam groove engaging member and having an arcuate cam bearing surface with a radius of curvature matching the radius of the cam barrel and a cam housing bearing surface with a radius of curvature matching the cam housing arcuate, radial bearing surface, wherein said cam surface engaging member is in continuous contact with the cam barrel outer surface and the cam housing arcuate, radial bearing surface.

2. The cam follower of claim 1 wherein said cam groove engaging member is cylindrical about an axis perpendicular to the axis of curvature of said cam bearing surface.

3. The cam follower of claim 1 wherein said cam surface engaging member is an arcuate flange of approximately constant thickness.

4. The cam follower of claim 3 wherein said flange has parallel side edges and parallel top edges.

5. The cam follower of claim 1 further comprising a carrier portion adapted to support a strand guide eye.

6. The combination of the cam follower of claim 1 and a cylindrical cam barrel having a predetermined outer radius, and a cam housing having an arcuate, radial bearing surface with a radius of curvature.

7. A reciprocating apparatus for use with an elongate cam follower guide having an arcuate, radial bearing surface with a radius of curvature, the apparatus comprising:

a cylindrical barrel cam having a central cam axis, a predetermined outer radius, an outer surface, and an oblique cam groove formed therein, said barrel cam being mounted for rotation about said cam axis; and a cam follower having a cam groove engaging surface and an arcuate cam bearing surface with a radius of curvature matched to said outer radius of said cam and a second arcuate, radial bearing surface with a radius of curvature matched to the radius of the elongate cam follower guide, said cam follower being disposed with said cam groove engaging surface engaged with said cam groove, said cam bearing surface being continuously engaged with said outer surface of said cam and said second arcuate, radial bearing surface being continuously engaged with the cam follower guide arcuate, radial bearing surface, whereby rotation of said cam about its central axis drives said cam follower parallel to said cam axis.

8. The reciprocating apparatus of claim 7, further comprising:

means for maintaining said cam bearing surface adjacent to said cam outer surface, whereby engagement of said cam bearing surface and said cam outer surface opposes rotation of said cam follower about an axis perpendicular to said central axis.

9. The combination of the reciprocating apparatus of claim 7 and an elongate cam follower guide having a longitudinal axis and disposed adjacent said cam with said longitudinal axis parallel to said central axis, said cam follower guide first arcuate radial bearing surface is facing and parallel to said cam outer surface.

10. The reciprocating apparatus of claim 8 wherein the axes of curvature of said arcuate radial bearing surfaces are coaxial with said cam axis.

11. The reciprocating apparatus of claim 8 wherein said cam follower guide further includes a first tangential bearing surface facing a direction parallel and opposite to the tangential direction of the cam outer surface adjacent the cam follower, and said cam follower further includes a second tangential bearing surface.

12. The reciprocating apparatus of claim 6 wherein the axis of curvature of said cam bearing surface is coaxial with said cam axis.

13. The reciprocating apparatus of claim 7 further comprising:

a strand guide coupled to said cam follower and wherein said apparatus is adapted to be disposed in operative relationship with a source of glass strand and a rotatable strand package winder, whereby reciprocating motion of said strand guide arranges the glass strand in helical pattern on a strand package.

14. A reciprocating apparatus comprising:

a cam cylinder having an outer radius and an outer, cam surface mounted for rotation about a longitudinal, cam axis of the cam cylinder;

a cam groove formed in the outer, cam surface of said cam cylinder;

a cam housing having an arcuate, radial bearing surface disposed to face radially inwardly adjacent said cam surface and having an axis of curvature coaxial with said cam axis, said radial bearing surface and said cam surface defining therebetween an annular cam follower cavity; and a cam follower having a cam groove engaging portion, a radial bearing flange having a first, inner, radial cam follower bearing surface and a second, outer, radial cam follower bearing surface, said first and second cam follower bearing surfaces being arcuate, with radii of curvature matching said cam outer surface and said cam housing radial bearing surface, said cam follower being disposed with said cam groove engaging portion engaging said cam groove and said radial bearing flange disposed in said cam follower cavity with the axes of curvature of said cam follower radial bearing surfaces coaxial with said cam axis, and with said cam follower radial bearing surfaces disposed in continuous slidable bearing engagement with said outer cam surface and said cam housing radial bearing surface, respectively.

15. The reciprocating apparatus of claim 13 wherein said cam housing further includes an elongate cam follower slot adjacent said cam housing radial bearing surface and having a longitudinal axis parallel to said cam axis and wherein said cam follower includes a carrier portion disposed to extend through said cam follower slot to the exterior of the cam housing.

16. The reciprocating apparatus of claim 14 wherein said cam follower slot includes a first housing tangential bearing surface disposed on one edge thereof and wherein said cam follower includes a first cam follower tangential bearing surface disposed to slidingly engage said first housing tangential bearing surface, whereby a tangential component of the force applied by the cam groove to the cam groove engaging portion when said cam is rotated in a first direction is opposed by engagement of the first tangential bearing surfaces.

17. The reciprocating apparatus of claim 15 wherein said cam follower slot includes a second housing tangential bearing surface disposed on a second edge thereof and wherein said cam follower includes a second cam follower tangential bearing surface disposed to slidingly engage said second housing tangential bearing surface, whereby a tangential component of the force applied by the cam groove to the cam groove engaging portion when said cam is rotated in a second direction, opposite to said first direction, is opposed by engagement of the second tangential bearing surfaces.

18. The reciprocating apparatus of claim 13 wherein said cam groove engaging portion is cylindrical about an axis perpendicular to the axis of curvature of said cam follower radial bearing surface.

19. The reciprocating apparatus of claim 17 wherein said cam groove is formed with no crossings.

20. The reciprocating apparatus of claim 13 wherein engagement of said first cam follower radial bearing surface and said cam outer surface opposes rotation of said cam follower about an axis perpendicular to said longitudinal axis.

* * * * *